US006352481B1

(12) United States Patent
Pak

(10) Patent No.: US 6,352,481 B1
(45) Date of Patent: Mar. 5, 2002

(54) GOLF SWING IMPROVING SYSTEM

(76) Inventor: Juntae Pak, 1938 S. 10th St., Philadelphia, PA (US) 19148

( * ) Notice: Subject to any disclaimer, the term of this patent is extended or adjusted under 35 U.S.C. 154(b) by 27 days.

(21) Appl. No.: 09/653,853

(22) Filed: Sep. 1, 2000

(51) Int. Cl.[7] ..... A63B 69/36

(52) U.S. Cl. ..... 473/219; 473/739; 473/261; 473/131

(58) Field of Search ..... 473/151, 154, 473/159, 160, 172, 197, 219, 231, 237, 238, 257, 261, 264, 265, 139, 131

(56) References Cited

U.S. PATENT DOCUMENTS

| | | | | | |
|---|---|---|---|---|---|
| 2,986,398 | A | | 5/1961 | Oliver | |
| 3,627,327 | A | | 12/1971 | White | |
| 3,687,457 | A | | 8/1972 | Mason et al. | |
| 3,756,606 | A | * | 9/1973 | Land | 473/172 |
| 3,758,116 | A | | 9/1973 | Pieronek | |
| 3,918,711 | A | * | 11/1975 | Zak | 473/197 |
| 4,511,146 | A | | 4/1985 | Windall | |
| 4,523,760 | A | | 6/1985 | Bednarczuk | |
| 4,685,682 | A | | 8/1987 | Isabell | |
| 4,826,174 | A | | 5/1989 | Hoyt, Jr. | |
| 4,913,439 | A | | 4/1990 | Ellington | |
| 4,932,657 | A | | 6/1990 | Hailer et al. | |
| 5,069,456 | A | | 12/1991 | Bellagamba | |
| 5,409,230 | A | * | 4/1995 | Dunaway et al. | 473/161 |
| D360,012 | S | | 7/1995 | Wisdom | |
| 5,478,077 | A | * | 12/1995 | Miyahara | 473/154 |
| 5,947,831 | A | * | 9/1999 | McCarthy | 473/197 |
| 6,089,989 | A | * | 7/2000 | Sutcliffe | 473/265 |
| 6,254,492 | B1 | * | 7/2001 | Taggett | 473/219 |
| 6,264,570 | B1 | * | 7/2001 | Yoon | 473/197 |

* cited by examiner

*Primary Examiner*—Mark S. Graham

(57) ABSTRACT

A golf swing improving system for teaching beginning golfers a conventional golf swing. The golf swing improving system includes a golf club, a striking mat and a block portion. The striking mat comprises a panel having a top edge. A frame portion has a leg portion and a foot portion integrally coupled together. The foot portion has at least two spike members integrally coupled thereto and extending downwardly therefrom. A bar is securely attached to and extends away from a free end of the foot portion. A plurality of hanging means removably couples the panel to the bar such that the panel hangs in a vertical orientation. The block portion includes a cushioning member. The panel and the cushioning member are struck with the golf club to improve a golf swing.

8 Claims, 6 Drawing Sheets

GOLF SWING IMPROVING SYSTEM

BACKGROUND OF THE INVENTION

1. Field of the Invention

The present invention relates to golf practicing devices and more particularly pertains to a new golf swing improving system for teaching beginning golfers a conventional golf swing.

2. Description of the Prior Art

The use of golf practicing devices is known in the prior art. More specifically, golf practicing devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,826,174; 5,069,456; 4,685,682; 4,932,657; 2,986,398; 3,627,327; 4,913,439; 4,511,146; 4,523,760; 3,687,457; 3,758,116; and U.S. Des. Pat. No. 360,012.

While these devices fulfill their respective, particular objectives and requirements, the aforementioned patents do not disclose a new golf swing improving system. The inventive device includes a golf club, a striking mat and a block portion. The striking mat comprises a panel having a top edge. A frame portion has a leg portion and a foot portion integrally coupled together. The foot portion has at least two spike members integrally coupled thereto and extending downwardly therefrom. A bar is securely attached to and extends away from a free end of the foot portion. A plurality of hanging means removably couples the panel to the bar such that the panel hangs in a vertical orientation. The block portion includes a housing having a back wall, a top wall, a bottom wall, and a pair of lateral side walls. The front side of the housing is open. A cushioning member is positioned in the housing and extends outwardly from the front side of the housing. A plate has a top surface and a bottom surface. The bottom wall is securely attached to the top surface of the plate. A plurality of spike members is integrally coupled to and extends downwardly away from the bottom surface of the plate. The panel and the cushioning member are struck with the golf club to improve a golf swing.

In these respects, the golf swing improving system according to the present invention substantially departs from the conventional concepts and designs of the prior art, and in so doing provides an apparatus primarily developed for the purpose of teaching beginning golfers a conventional golf swing.

SUMMARY OF THE INVENTION

In view of the foregoing disadvantages inherent in the known types of golf practicing devices now present in the prior art, the present invention provides a new golf swing improving system construction wherein the same can be utilized for teaching beginning golfers a conventional golf swing.

The general purpose of the present invention, which will be described subsequently in greater detail, is to provide a new golf swing improving system apparatus and method which has many of the advantages of the golf practicing devices mentioned heretofore and many novel features that result in a new golf swing improving system which is not anticipated, rendered obvious, suggested, or even implied by any of the prior art golf practicing devices, either alone or in any combination thereof.

To attain this, the present invention generally comprises a golf club, a striking mat and a block portion. The striking mat comprises a panel having a top edge. A frame portion has a leg portion and a foot portion integrally coupled together. The foot portion has at least two spike members integrally coupled thereto and extending downwardly therefrom. A bar is securely attached to and extends away from a free end of the foot portion. A plurality of hanging means removably couples the panel to the bar such that the panel hangs in a vertical orientation. The block portion includes a housing having a back wall, a top wall, a bottom wall, and a pair of lateral side walls. The front side of the housing is open. A cushioning member is positioned in the housing and extends outwardly from the front side of the housing. A plate has a top surface and a bottom surface. The bottom wall is securely attached to the top surface of the plate. A plurality of spike members is integrally coupled to and extends downwardly away from the bottom surface of the plate. The panel and the cushioning member are struck with the golf club to improve a golf swing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new golf swing improving system apparatus and method which has many of the advantages of the golf practicing devices mentioned heretofore and many novel features that result in a new golf swing improving system which is not anticipated, rendered obvious, suggested, or even implied by any of the prior art golf practicing devices, either alone or in any combination thereof.

It is another object of the present invention to provide a new golf swing improving system which may be easily and efficiently manufactured and marketed.

It is a further object of the present invention to provide a new golf swing improving system which is of a durable and reliable construction.

An even further object of the present invention is to provide a new golf swing improving system which is susceptible of a low cost of manufacture with regard to both materials and labor, and which accordingly is then susceptible of low prices of sale to the consuming public, thereby making such golf swing improving system economically available to the buying public.

Still yet another object of the present invention is to provide a new golf swing improving system which provides in the apparatuses and methods of the prior art some of the advantages thereof, while simultaneously overcoming some of the disadvantages normally associated therewith.

Still another object of the present invention is to provide a new golf swing improving system for teaching beginning golfers a conventional golf swing.

Yet another object of the present invention is to provide a new golf swing improving system which includes a golf club, a striking mat and a block portion. The striking mat comprises a panel having a top edge. A frame portion has a leg portion and a foot portion integrally coupled together. The foot portion has at least two spike members integrally coupled thereto and extending downwardly therefrom. A bar is securely attached to and extends away from a free end of the foot portion. A plurality of hanging means removably couples the panel to the bar such that the panel hangs in a vertical orientation. The block portion includes a housing having a back wall, a top wall, a bottom wall, and a pair of lateral side walls. The front side of the housing is open. A cushioning member is positioned in the housing and extends outwardly from the front side of the housing. A plate has a top surface and a bottom surface. The bottom wall is securely attached to the top surface of the plate. A plurality of spike members is integrally coupled to and extends downwardly away from the bottom surface of the plate. The panel and the cushioning member are struck with the golf club to improve a golf swing.

Still yet another object of the present invention is to provide a new golf swing improving system that includes a striking mat for teaching a golfer how to gain a proper tilt of their spine when addressing and striking a golf ball.

Even still another object of the present invention is to provide a new golf swing improving system that includes a block portion for teaching a golfer to contact a ball squarely with the head of a golf club.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
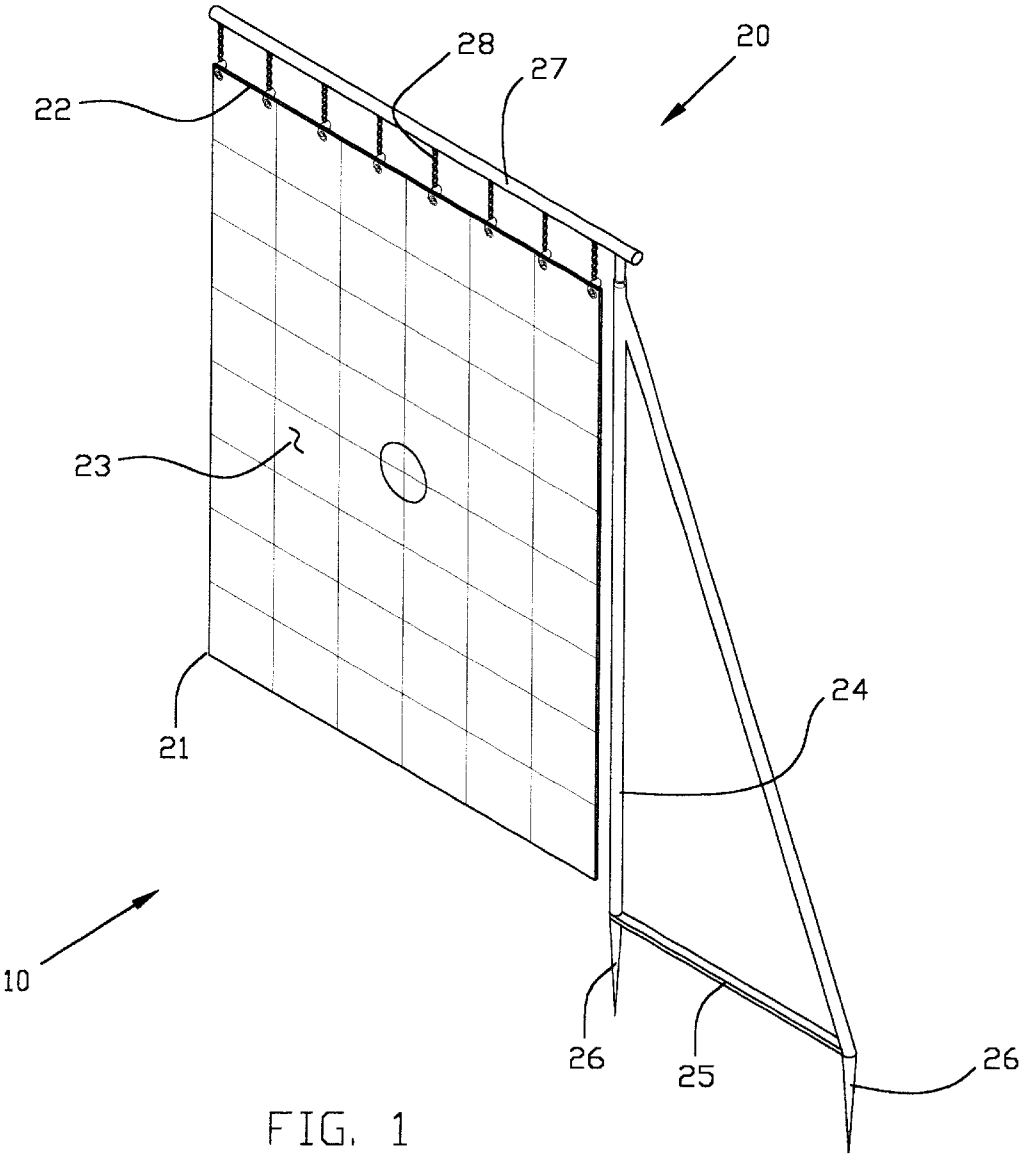
FIG. 1 is a schematic perspective view of a striking mat of a new golf swing improving system according to the present invention.
Figure 2:
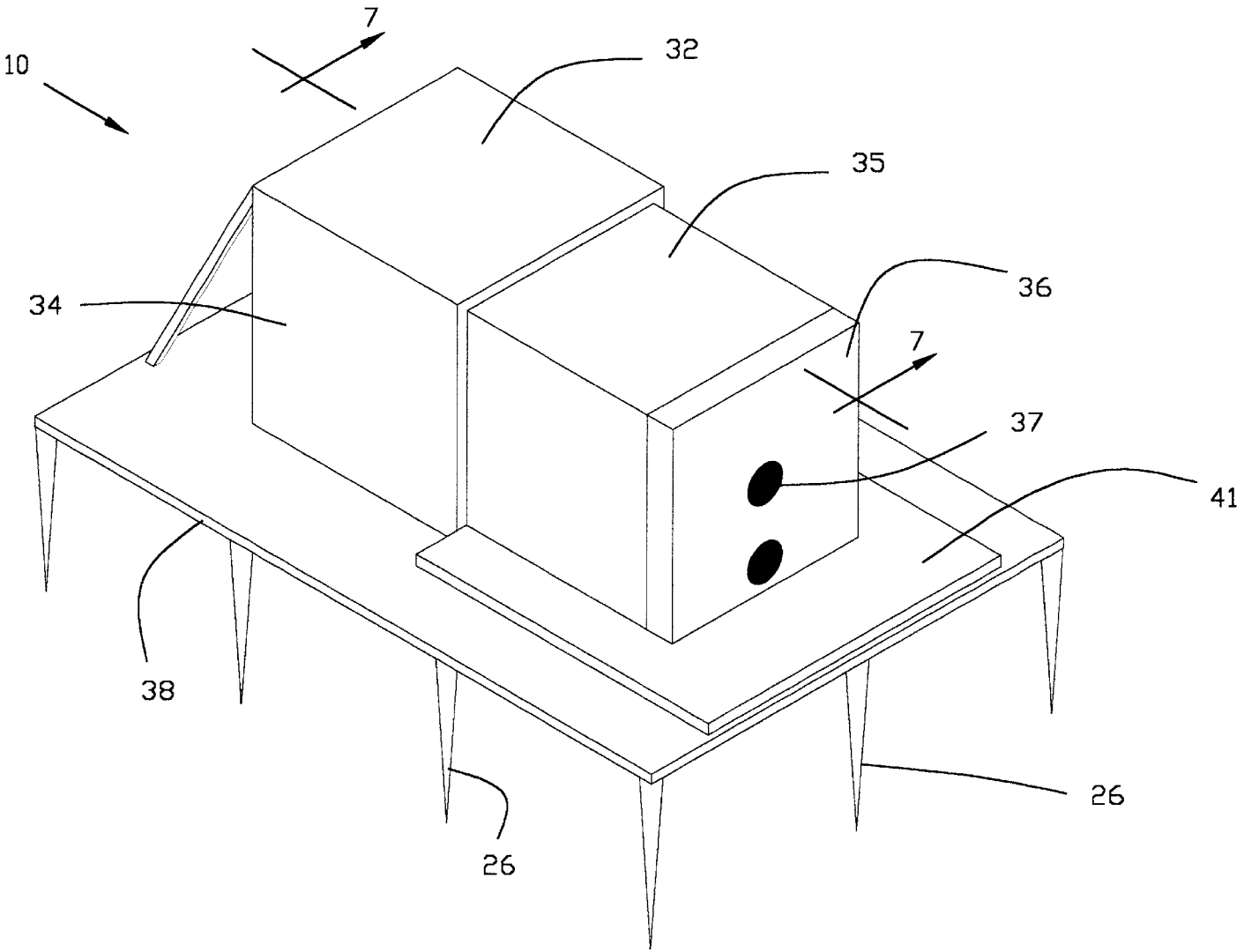
FIG. 2 is a schematic perspective view of the block portion of the present invention.
Figure 3:
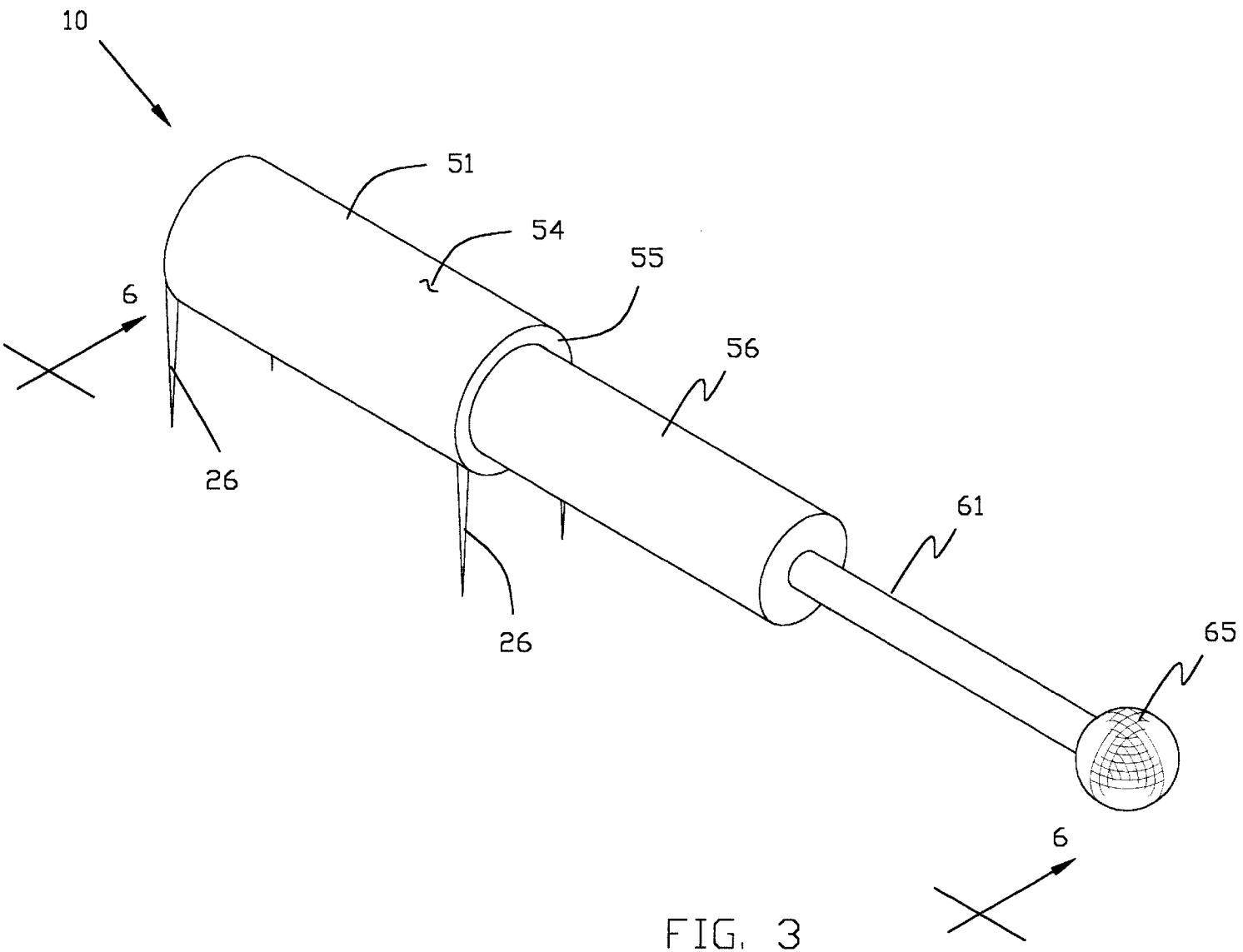
FIG. 3 is a schematic perspective view of the putting assembly of the present invention.
Figure 4:
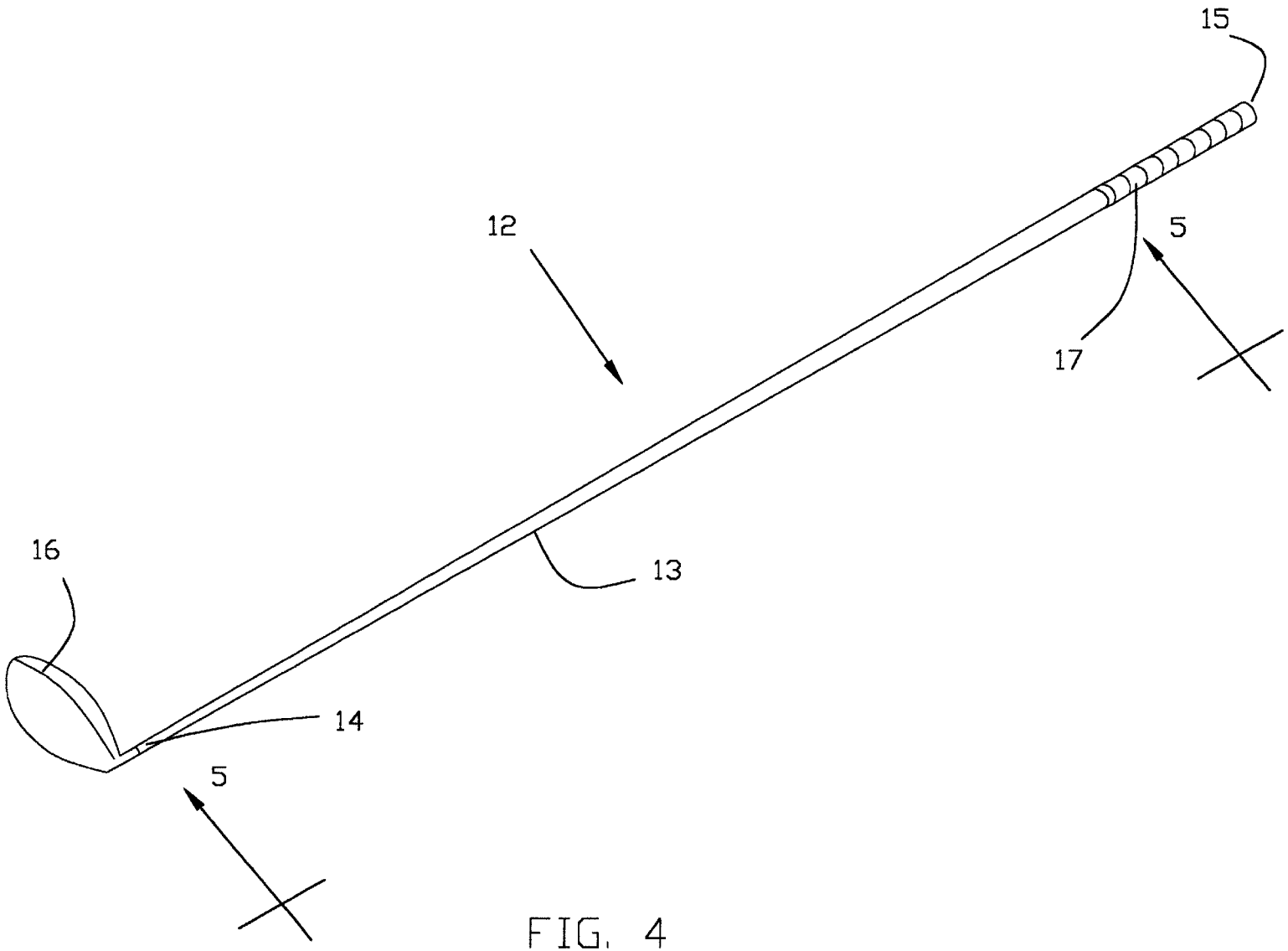
FIG. 4 is a schematic perspective view of the golf club of the present invention.
Figure 5:
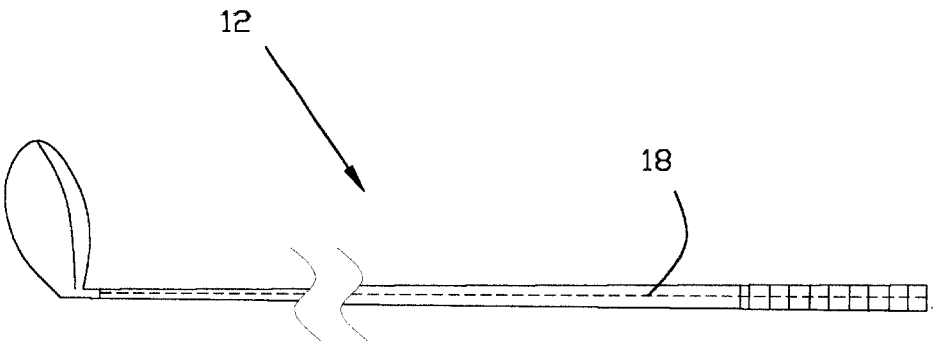
FIG. 5 is a schematic side view of the golf club of the present invention.
Figure 6:
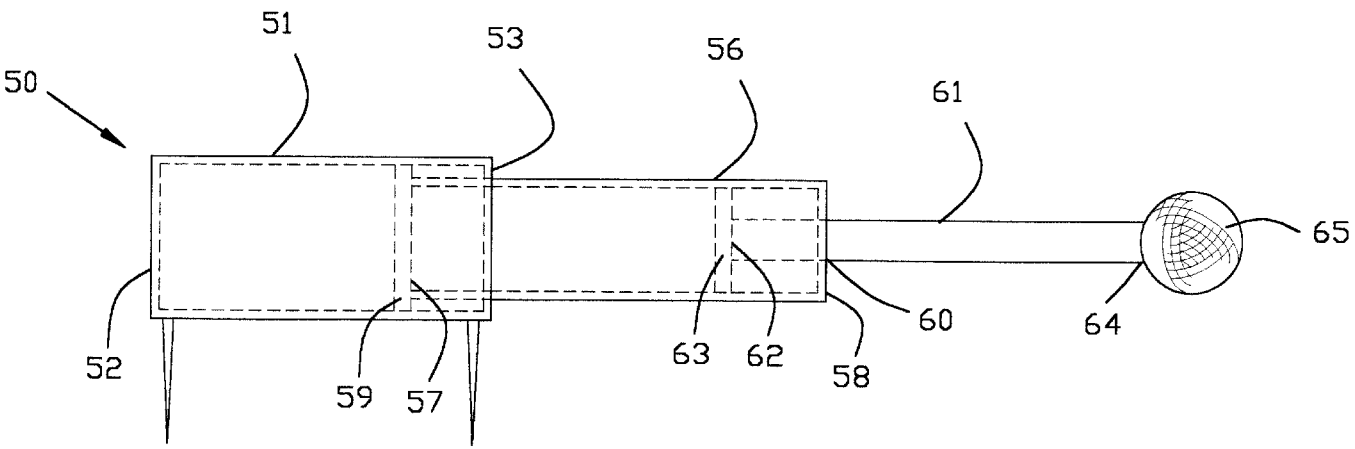
FIG. 6 is a schematic side view of the putting assembly of the present invention.
Figure 7:
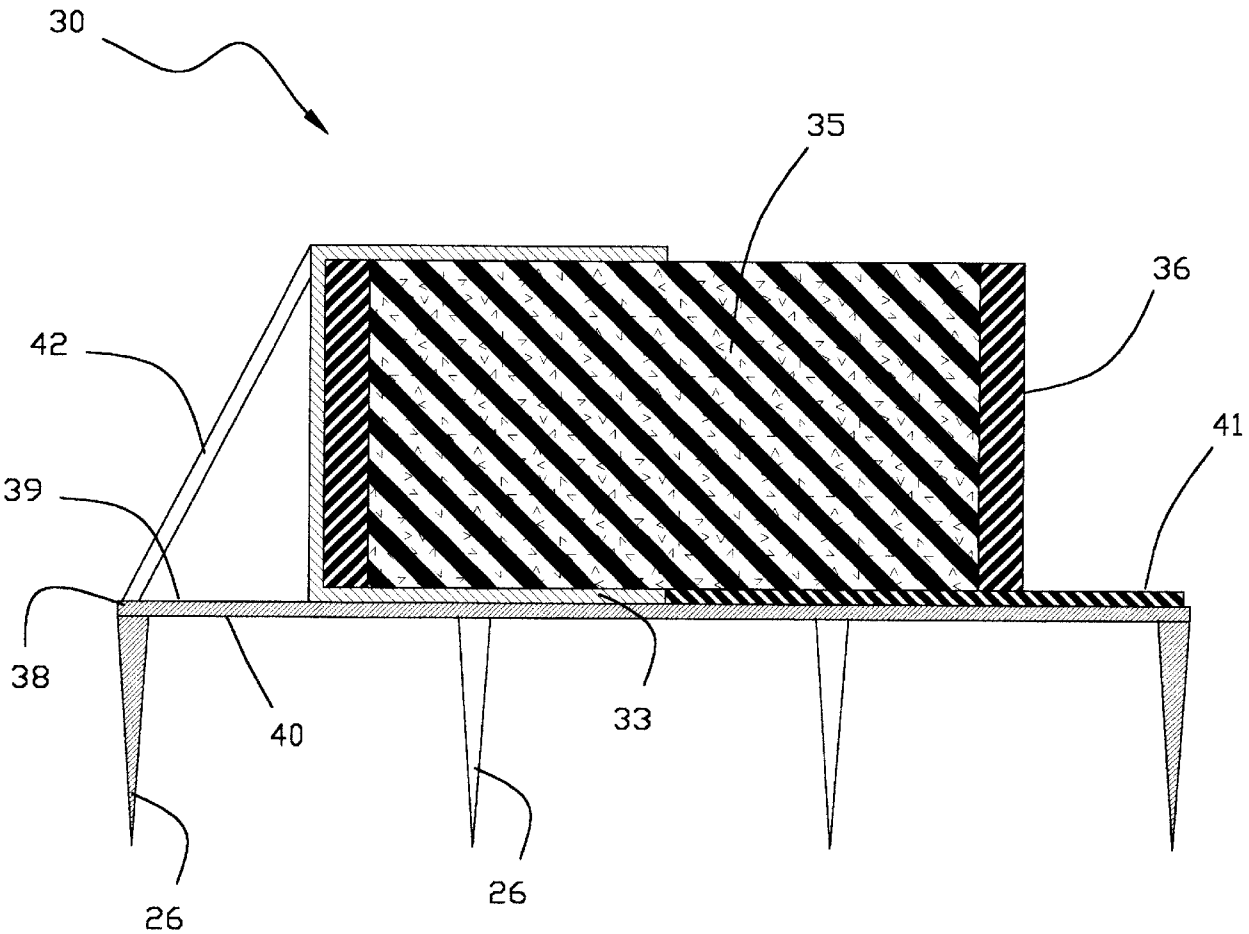
FIG. 7 is a schematic cross-sectional view taken along line 7—7 of the present invention.

With reference now to the drawings, and in particular to FIGS. 1 through 7 thereof, a new golf swing improving system embodying the principles and concepts of the present invention and generally designated by the reference numeral 10 will be described.

As best illustrated in FIGS. 1 through 7, the golf swing improving system 10 generally includes a golf club 12. The golf club 12 comprises a shaft 13 having a first end 14 and a second end 15. A head portion 16 is securely attached to the first end 14 of the shaft. A handle portion 17 extends around the shaft and is positioned adjacent to and covering the second end 15. The shaft 13 is resiliently flexible. Ideally, the shaft 13 is flexible to the point that a reinforcing wire 18 is needed to keep the shaft 13 in a generally linear alignment.

A striking mat 20 for striking with the golf club 12 includes a panel 21 having a top edge 22 and a front side 23. The front side 23 has grid indicia thereon. The panel 21 comprises a generally flexible material, which is preferably a plastic, a cloth or an elastomeric material. The panel 21 preferably has a width between 2 feet and 4 feet and a length between 2 feet and 4 feet.

A frame portion holds the panel 21 in a vertical orientation. The frame portion has a leg portion 24 and a foot portion 25 integrally coupled together. The foot portion 25 has at least two spike members 26 integrally coupled thereto and extending downwardly therefrom. A bar 27 is securely attached to and extends away from a free end of the leg portion 24 such that the bar is generally orientated perpendicular to the foot portion 25.

A plurality of hanging means 28 removably couple the panel to the bar such that the panel 21 hangs in a vertical orientation. The hanging means are preferably chains or hooks that extend through apertures in the panel 21 so that the panel may swing freely on the bar 27.

A block portion 30 for hitting with the golf club includes a housing having a back wall 31, a top wall 32, a bottom wall 33, and a pair of lateral side walls 34. The front side of the housing is open.

A cushioning member 35 is positioned in the housing and extends outwardly from the front side of the housing. The cushioning member 35 ideally comprises a foamed elastomeric material. Preferably, a front surface of the cushioning member has an elastomeric panel 36 securely attached thereto. The elastomeric panel preferably has a pair of target indicia 37 thereon.

A plate 38 has a top surface 39 and a bottom surface 40. The bottom wall 33 is securely attached to the top surface 39 of the plate 38. A second elastomeric panel 41 is securely attached to the top surface 39 of the plate 38 and positioned between the plate 38 and the cushioning member 35.

A plurality of spike members 26 is integrally coupled to and extend downwardly away from the bottom surface 40 of the plate 38.

A reinforcing member 42 ideally extends between and is securely attached to the plate 38 and a junction of the top wall 32 and the back wall 31.

A putting assembly 50 includes a first tube 51 having a first end 52, a second end 53 and a peripheral wall 54 extending therebetween. The second end 53 is open and has an annular lip 55 extends inwardly therefrom.

A plurality of spike members 26 is integrally coupled to the peripheral wall 54 of the first tube 51. Each of the spike members 26 coupled to the first tube 51 extends in downwardly in a generally parallel direction with respect to each other.

A second tube 56 has a first end 57 and a second end 58. The second tube 56 is movably extended into the first tube 51 such that the first end 57 of the second tube 56 is positioned within the first tube 51. A first annular flange 59 for abutting against the annular lip 55 and slidably abutting an internal surface of the first tube 51 is integrally coupled to and extending away from the first end 57 of the second tube 56. The second end 58 of the second tube 56 has a hole 60 therein.

A rod 61 extends into the hole 60 such that a first end 62 of the rod 61 is positioned within the second tube 56. A second annular flange 63 for slidably abutting an internal surface of the second tube 56 is integrally coupled to and extends away from the first end 62 of the rod 61. A ball 65 is securely attached to a second end 64 of the rod 61.

In use, the user first begins by placing the spike members 26 of the frame portion into the ground and hanging the panel 21 from the bar 27. The user hits the middle of the panel with the golf club 12 generally using a baseball swing. The user eventually hits lower and lower on the panel until a general golf swing is established. Next, the spike members on the plate 38 are inserted into the ground and the panel is removed from the bar. The user stands on the panel according to predetermined markings on the grid for a proper stance. The user then hits the front surface of the cushioning member 35 with the club 12. The sound of the contact will help the user know when they are hitting the cushioning member with the face of the club or if the club face is open or closed. The flexible shaft 13 helps to train the person to have a square face at impact. Finally, the putting stroke is worked on by hitting the ball 65 on the rod 61. Square contact with the ball using a putter will send the rod 61 into the second tube 56 and the second tube 56 into the first tube 51.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A golf swing practice system, said system comprising:
- a golf club;
- a striking mat, said striking mat comprising;
  - a panel, said panel having a top edge;
  - a frame portion, said frame portion having a leg portion and a foot portion integrally coupled together, said foot portion having at least two spike members integrally coupled thereto and extending downwardly therefrom;
  - a bar being securely attached to and extending away from a free end of said leg portion such that said bar is generally orientated perpendicular to said foot portion;
  - a plurality of hanging means removably coupling said panel to said bar such that said panel hangs in a vertical orientation;
- a block portion, said block portion comprising;
  - a housing having a back wall, a top wall, a bottom wall, and a pair of lateral side walls, said front side of said housing being open;
  - a cushioning member, said cushioning member being positioned in said housing and extending outwardly from said front side of said housing;
  - a plate, said plate having a top surface and a bottom surface, said bottom wall being securely attached to said top surface of said plate;
  - a plurality of spike members being integrally coupled to and extending downwardly away from said bottom surface of said plate.

2. The golf swing practice system as in claim 1, wherein said golf club comprises:
- said golf club including a shaft, said shaft having a first end and a second end, a head portion being securely attached to said first end of said shaft, a handle portion extending around said shaft and being positioned adjacent to and covering said second end, said shaft being resiliently flexible.

3. The golf swing practice system as in claim 1, wherein said panel further comprises:
- said panel having a top edge and a front side, said front side having grid indicia thereon, said panel comprising a generally flexible material.

4. The golf swing practice system as in claim 1, wherein said cushioning member further comprises:
- a foamed elastomeric material, a front surface of said cushioning member having an elastomeric panel securely attached thereto.

5. The golf swing practice system as in claim 4, wherein said block portion further comprises:
- a second elastomeric panel being securely attached to said top surface of said plate and positioned between said plate and said cushioning member.

6. The golf swing practice system as in claim 1, further comprising a putting assembly.

7. The golf swing practice system as in claim 6, wherein said putting assembly further comprises:
- a first tube, said first tube having a first end, a second end and a peripheral wall extending therebetween;
- a plurality of spike members being integrally coupled to said peripheral wall of said first tube;
- a second tube, said second tube having a first end and a second end, said second tube being movably extended into an opening in said second end of said first tube;

a rod, said rod extending into a hole in said second end of said second tube; and a ball, said ball being securely attached to an end of said rod.

8. A golf swing practice system, said system comprising:

a golf club, said golf club including a shaft, said shaft having a first end and a second end, a head portion being securely attached to said first end of said shaft, a handle portion extending around said shaft and being positioned adjacent to and covering said second end, said shaft being resiliently flexible;

a striking mat, said striking mat comprising;

a panel, said panel having a top edge and a front side, said front side having grid indicia thereon, said panel comprising a generally flexible material, said panel generally having a width between 2 feet and 4 feet and a length between 2 feet and 4 feet;

a frame portion, said frame portion having a leg portion and a foot portion integrally coupled together, said foot portion having at least two spike members integrally coupled thereto and extending downwardly therefrom;

a bar being securely attached to and extending away from a free end of said leg portion such that said bar is generally orientated perpendicular to said foot portion;

a plurality of hanging means removably coupling said panel to said bar such that said panel hangs in a vertical orientation;

a block portion, said block portion comprising;

a housing having a back wall, a top wall, a bottom wall, and a pair of lateral side walls, said front side of said housing being open;

a cushioning member, said cushioning member being positioned in said housing and extending outwardly from said front side of said housing, said cushioning member comprising a foamed elastomeric material, a front surface of said cushioning member having an elastomeric panel securely attached thereto;

a plate, said plate having a top surface and a bottom surface, said bottom wall being securely attached to said top surface of said plate, a second elastomeric panel being securely attached to said top surface of said plate and positioned between said plate and said cushioning member;

a plurality of spike members being integrally coupled to and extending downwardly away from said bottom surface of said plate;

a reinforcing member extending between and being securely attached to said plate and a junction of said top wall and said back wall;

a putting assembly, said putting assembly comprising;

a first tube, said first tube having a first end, a second end and a peripheral wall extending therebetween, said second end being open and having an annular lip extending inwardly therefrom;

a plurality of spike members being integrally coupled to said peripheral wall of said first tube, each of said spike members coupled to said first tube extending in downwardly in a generally parallel direction with respect to each other;

a second tube, said second tube having a first end and a second end, said second tube being movably extended into said first tube such that said first end of said second tube is positioned within said first tube, a first annular flange for abutting against said annular lip and slidably abutting an internal surface of said first tube being integrally coupled to and extending away from said first end of said second tube, said second end of said second tube having a hole therein;

a rod, said rod extending into said hole such that a first end of said rod is positioned within said second tube, a second annular flange for slidably abutting an internal surface of said second tube being integrally coupled to and extending away from said first end of said rod; and a ball, said ball being securely attached to a second end of said rod.

* * * * *